United States Patent [19]

Doyle

[11] Patent Number: 4,913,659

[45] Date of Patent: Apr. 3, 1990

[54] PUSH CAP TERMINALS AND TERMINAL BOARDS WITH SAME

[75] Inventor: Clarence E. Doyle, Chester, N.J.

[73] Assignee: American Telephone and Telegraph Company, AT & T Bell Laboratories, Murray Hill, N.J.

[21] Appl. No.: 373,834

[22] Filed: Jun. 29, 1989

[51] Int. Cl.[4] ..... H01R 4/24

[52] U.S. Cl. ..... 439/395

[58] Field of Search ..... 439/389–426

[56] References Cited

U.S. PATENT DOCUMENTS

| | | | |
|---|---|---|---|
| 4,073,560 | 2/1978 | Anhalt et al. | 439/400 |
| 4,688,872 | 8/1987 | Pohl | 439/399 |
| 4,702,544 | 10/1987 | Vachhani et al. | 439/400 |

*Primary Examiner*—Joseph H. McGlynn

*Attorney, Agent, or Firm*—Ruloff F. Kip

[57] ABSTRACT

A terminal board has a base plate and rows and columns of terminals upstanding from such plate. Each terminal comprises (a) an insulative hollow post (b) a metallic terminal strip in the post and having a pair of tangs separated by a contact gap and projecting above part of the post, and (c) a hollow cap fitted on such post to enclose such tangs and gap and shiftable on such post between up and down detained positions. The cap on opposite sides has entrance and exit holes aligned diagonal to such rows and columns, with the entrance hole having an inwardly downward slant and the exit hole being horizontal. With the cap in up position, an insulated lead is fed into the entrance hole and then passed partly or fully through the exit hole which initially impedes full passage through it of the lead.

The cap is then pushed on the post to down position to cause the lead to be driven against the tangs and into the contact gap such that the lead's insulation is cut and the metallic core of the lead contacts the tangs. The cap may be fitted on the post in either of two positions so that the lead passes either frontwardly or backwardly through the gap.

20 Claims, 6 Drawing Sheets

PUSH CAP TERMINALS AND TERMINAL BOARDS WITH SAME

FIELD OF THE INVENTION

This invention relates generally to terminal boards and terminals therein for effecting electrical interconnections. More particularly, this invention relates to terminals and terminal boards of such kind for connecting insulated wire leads (e.g. jumper leads) to other wires such as wires incorporated in cables.

BACKGROUND OF THE INVENTION

The conventional terminal board for connecting jumper type wire leads comprises a flat platelike horizontal base and an array of binding post terminals upstanding from that base, each such terminal comprising a vertical cylindrical post, a threaded rod coaxial with and of smaller diameter than the post and projecting upwards from its top, and a gnarled circular nut received in threaded relation on the rod at its top. An insulated wire lead is connected to such terminal by stripping the insulation from a free end of the lead, shaping that free end to curve back on itself to form a hook, placing such hook in the vertical gap between the top of the post and the bottom of the nut so that the hook encircles the vertical rod, and then screwing the nut down on the rod to squeeze the hooked free end of the lead between the post and nut and thereby make electromechanical contact between the lead and the terminal.

While terminal boards of the sort described have been in widespread use for many years, they are subject to various disadvantages of which some are as follows. While the insulation is being stripped from the lead, it is easy for its metal core to be nicked so as to ultimately result in parting of the lead at the nick. Further, the requirements that the stripped free end be bent into hook form and then placed around the rod, and the nut then screwed down, are burdensome in that undue time and labor must be spent to fulfill them. Still further, the lead, after connection to the terminal, is poorly protected in the sense that the lead is directly connected to the bare nut so as to, say, become grounded in the event something touches the nut to ground it.

Presumably to overcome such disadvantages, there has recently been developed by the Reliable Electric Manufacturing Company a different kind of terminal board in which the mentioned posts on the horizontal base have been replaced by insulated housings arranged in rows and columns on the base. These housings support respective push-down insulated cap in each of which are a pair of entrance holes for insertion thereinto of the free ends of a pair of electrical conductors as, say, paired tip and ring conductors. Once such conductors have been inserted into a particular cap, that cap is pushed down relative to its housing, and that pushing down causes the free ends of the inserted conductors to be electromechanically connected with respective metallic terminal elements received in the housing and in turn connected with other conductors disposed under such base.

A problem with such a terminal board, however, is that the entrance holes for threading the leads into the caps are horizontal and parallel to the base. As a result, such terminal board is disadvantageous in the respect that, in order to thread a lead into an entrance hole of the cap of a particular terminal, it is necessary that the hand which grasps and guides the lead be positioned awkwardly close to the base of the board and be kept in that position while being moved parallel to the base in order to guide the lead into the hole. Further, in trying to so move the hand in order to feed the lead into the hole, it is easy for the hand or the lead grasped thereby to be thrown off course by bumping into a housing adjacent to the one into which the lead is being guided. Thus, with a terminal board of the sort just described, the process of threading the leads into the entrance holes in the terminals on the board is unduly difficult and time consuming.

SUMMARY OF THE INVENTION

These and other disadvantages of the terminal board last described are obviated according to the invention in one of its aspects by providing for use with such a board of a terminal for an insulated wire lead comprising housing means upstanding from a base region thereof and electroconductive means disposed at least partly in said housing means and having a portion connectable to a wire, said housing means being perforated by an entrance hole which passes through said housing means in the inward direction from the outside to the inside thereof, and which slants downwardly in such direction towards said base region, and such hole being adapted for insertion therein of the mentioned lead for electromechanical connection in said housing means of said lead to said electroconductive means. Such terminal is thus adapted to electrically couple that lead through such electroconductive means to the mentioned wire. Because of the downward slant of the entrance hole for the lead, the hand which feeds the lead into the hole may be positioned well outward of the terminal so that it is easy during such feeding to avoid such hand (or such lead) being contacted by an adjacent terminal to cause misdirection of the guidance necessary to insert the lead into the hole. Thus, the process of connecting the lead to the terminal is greatly facilitated.

According to the invention in other of its aspects, when the terminal board comprises rows and columns of terminals, the entrance holes in such terminals may align diagonally with the lines of such rows and columns to promote in that way the ease with which the leads may be guided and fed into the entrance holes. Further, the terminals may have exit holes for the leads and each include therein a provisional stop means adapted to initially impede passage through such hole of a lead inserted in the terminal but, with subsequent manipulation of the lead, to cease such impeding action and permit such passage. Yet further, the entrance hole in such housing means may be found in an upper part of such means constituting a cap which is seatable on a lower part of such means in either one of two predetermined cap positions so as to permit a lead inserted into the hole to be connected in the housing means either frontwardly or backwardly to the electroconductive means therein. Still other aspects of the invention will be evident from a reading of what follows herein.

BRIEF DESCRIPTION OF THE DRAWING

For a better understanding of the invention, reference is made to the following description of a detailed embodiment thereof and to the accompanying drawings wherein.

DETAILED DESCRIPTION OF EMBODIMENT

Figure 1:
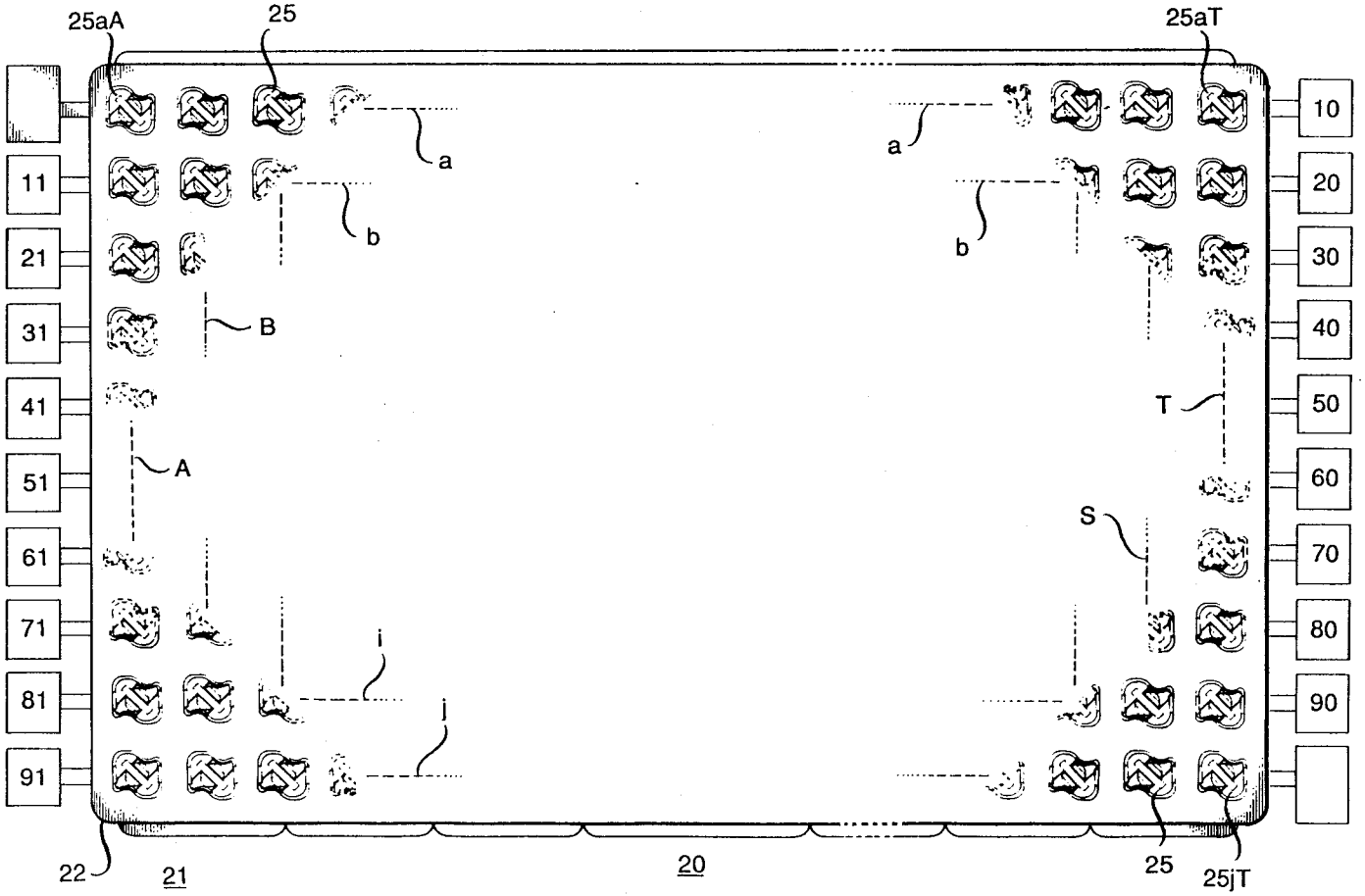
FIG. 1 is a plan view of a terminal board which is an exemplary embodiment of the invention.

Referring now to FIG. 1, the reference numeral 20 designates a terminal board which when installed has normally a vertical lie but which, for convenience, is shown in FIG. 1 as having a horizontal lie. The major part of board 20 is a molded synthetic resinous piece 21 comprising a base 22 in the form of a horizontal rectangular base plate, a plurality of posts 25 upstanding from base 22 and integral therewith and a circumferential flange 26 (FIG. 4) downstanding from the perimeter of base plate 22. The posts 25 are adapted to be fitted with caps (later described) with each post and cap constituting a housing means. As shown in FIG. 1, the posts 25 are arranged on base 22 in rows and columns of which the centerlines for the rows are designated a,b, . . . i,j, and the centerlines of the columns are designated A,B, . . . S,T. All the posts 25 are duplicates of each other. The location of any particular post on base 22 can be indicated by an appropriate designatory suffix. Thus, for example, the post located at the intersection of row a and column T can be designated as the post 25*a*T. When, however, reference is made hereinafter to a single post designated as post 25, that designation shall, unless the context otherwise requires, be taken as a reference to the post more fully designated as post 25*a*A and located in FIG. 1 in the upper left hand corner of base 22.

Figure 2:
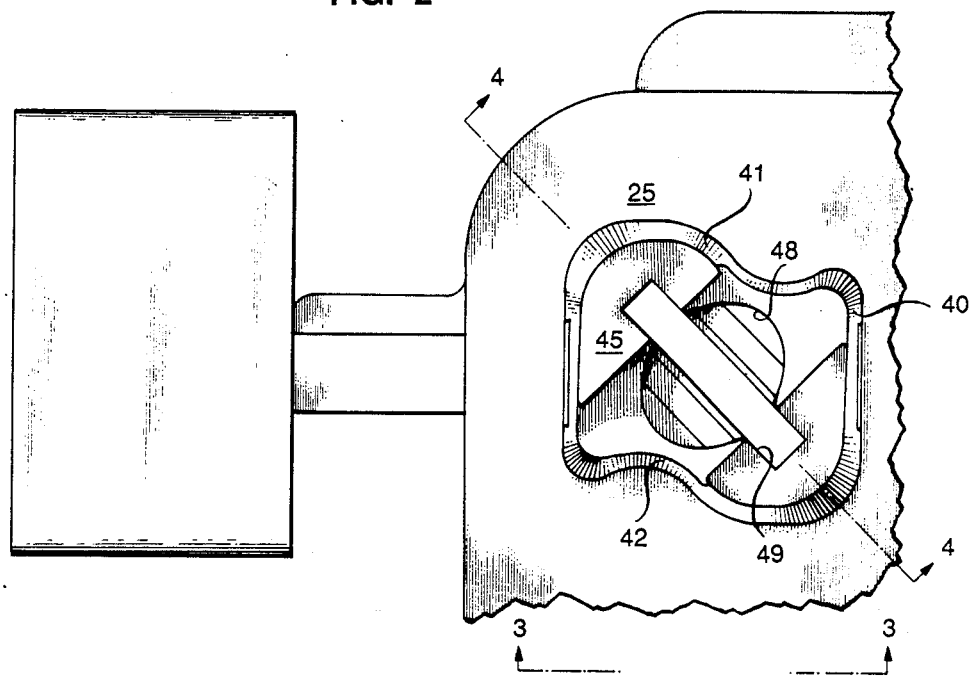
FIG. 2 is an enlarged fragmentary plan view of a portion of the FIG. 1 board and of one of the posts thereon.
Figure 3:
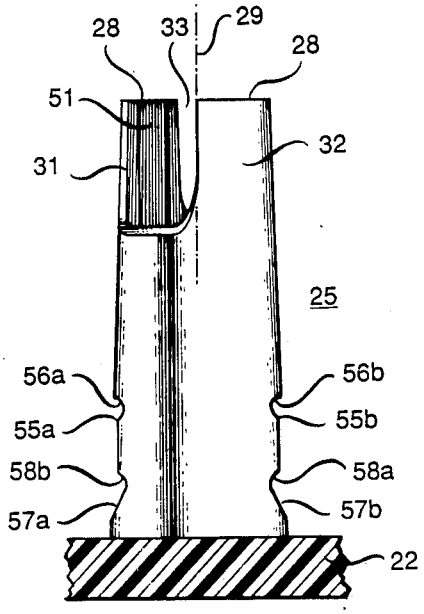
FIG. 3 is a front elevation of the post shown in FIG. 2 and a fragmentary view in cross-section of a portion of the board underlying the post.
Figure 6:
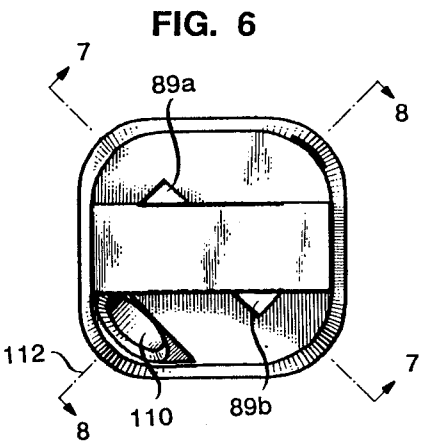
FIG. 6 is a plan view of a cap adapted to fit on the FIG. 4 post.
Figure 4:
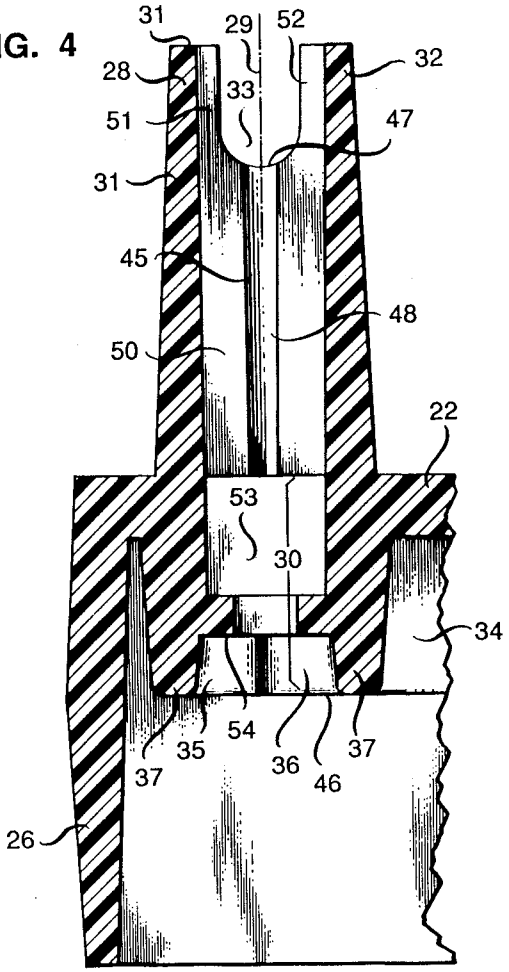
FIG. 4 is a view, taken as indicated by the arrows 4—4 in FIG. 2 of an enlarged diagonal cross-section of the FIG. 2 post.

Referring now to FIGS. 2–4, post 25 is an insulative hollow body having a vertical axis 29 and a base region 30 (FIG. 4) at and below the region of the post's junction with the base plate 22 of board 20. The post is upstanding from that region and has a slight convergent taper in the upward direction. Towards its top 28, the post is shaped to have two upwardly extending arms 31 and 32 horizontally spaced diagonally from each other (i.e., at 45° to the row lines and column lines on base 22) and separated from each other by a deep "U" shaped cleft 33.

The base plate 22 below its bottom is reinforced by a series of ribs projecting downward from such bottom and extending horizontally parallel to the row lines on the base. One such rib 34 is at the back (FIG. 4) of a bottom socket 35 for post 25, such socket in horizontal cross-section being in the form of a square, and one side of such square socket being provided by a portion 36 of such rib. The remainder of such socket is provided by a ridge 37 projecting downwards from such base and conforming in horizontal shape to three sides of such square and extending around axis 29 be connected at its opposite ends to rib 34. The socket 35 is thus rimmed on one side by the rib portion 36 and on its other three sides by the dependent ridge 37.

Above base region 30 the exterior surface 40 of post 25 has in the horizontal plane (FIG. 2) the general configuration of the outline of a square with rounded corners. Surface 40 has, however, two regions 41 and 42 on opposite sides of axis 29 (to be angularly spaced from each other by 180° around such axis) and at which the generally square outline of such surface is modified to have an incurrvature. To put it another way, if the outline of the exterior surface 40 of post 25 is considered as being generated by a radius sweeping angularly around axis 29 in the horizontal plane, such outline is characterized by a radial variation which is recurrent in each 180° interval around such axis but is non-recurrent in any lesser angular interval. That is surface 40 has a configuration which is radially symmetrical but not axially symmetrical.

Formed in post 25 is a vertical passage 45 extending from a lower opening 46 therefor in the bottom of socket 35 upwardly to the top 28 of the post. Passage 45 comprises two components at 90° to each other and each at 45° to the row lines and column lines on base 22, such two components being (a) a hollow 48 of elliptical horizontal cross-section extending upwards from the top of base region 30 to a forward opening 47 at the bottom of "U" cleft 33 and (b) a slot 49 of rectangular horizontal cross-section and comprising a fully enclosed channel 50 extending from the top of socket 35 to such upper or forwarding opening 47.

The slot 49 in its horizontal cross-section has a greater width dimension than thickness dimension. Above forward opening 47 the cross-section of slot 49 remains constant but the "U" cleft 33 formed in the top post 25 opens up portions of the wide sides of the slot. Accordingly, above such opening, slot 49 converts into two guideways 51 and 52 found in, respectively, post arms 31 and 32 and extending upwardly in these arms from the opening 47 to the top 28 of the post. The fully enclosed channel 50 provided by slot 49 is vertically divided into an upper channel section 53 of fully width and a lower constricted section 54 of lesser width than section 53.

As best shown in FIG. 3, the post 25 has formed in its exterior a pair of linear grooves 55*a*, 55*b* on opposite sides of axis 29 and at the same height and bounded on their upper sides by downwardly directed faces 56*a*, 56*b* with downward slants in the radially inward direction, i.e., the direction towards such axis. Below the grooves 55, there are found in the post's exterior a second pair of linear grooves 57*a*, 57*b* similar to the grooves 55 except that the faces 58*a*, 58*b* on the upper sides of grooves 57 have a greater downward slant than do the faces 56 of the upper grooves.

Figure 5:
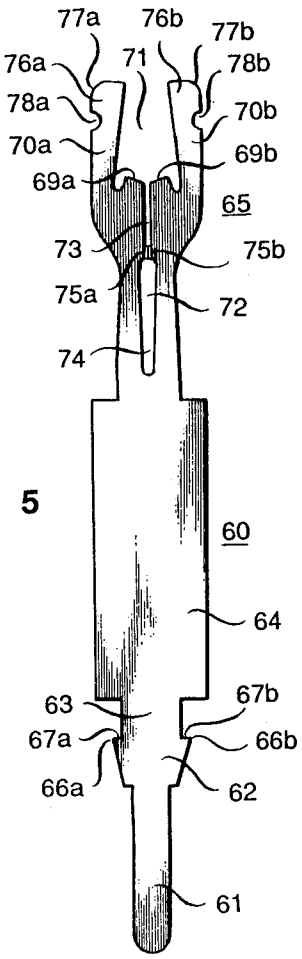
FIG. 5 is an enlarged front elevational view of a terminal strip adapted to be included in the FIG. 2 post.

The passage 45 in post 25 is adapted to have received therein and electroconductive means in the form of the metallic terminal strip 60 shown in FIG. 5. Strip 60 is constructed of platinum washed phosphor bronze, or beryllium-copper alloy or another metal or alloy combining good electroconductivity with high mechanical strength and resilience. Structurally speaking, the strip 60 comprises from bottom to top a lower stem 61, a section 62 having a downwardly convergent taper, a constricted wider section 63, a full width section 64 and an upper section 65. The tapered sides of section 62 terminate at its junction with section 63 in a pair of barbs 66*a*, 66*b* providing upwardly facing shoulders 67*a*, 67*b*, the tips of the barbs being spaced from each other in an amount slightly greater than the width of the constricted section 54 (FIG. 4) of slot channel 50 in post 25. The widths of the sections 63 and 64 of the strip 60 have values to permit those sections to be received with a close fit in, respectively, the sections 54 and 53 of such channel 50.

The upper section 65 of strip 60 comprises a pair of upwardly extending tangs 70*a*, 70*b* separated from each other in the width dimension of the strip by a relatively wide and deep receiving notch 71. The tangs 70*a*, 70*b* are shaped to provide at the bottom of such notch a pair of curved cutting edges 69*a*, 69*b* facing upwards into such notch at the margins of such tangs bordering the notch bottom. Below the bottom of notch 71, the tangs 70 are separated by a vertical contact gap 72 formed by lancing and extending downward into strip 60 to the bottom ends of the tangs. The gap 72 has narrower and wider upper and lower sections 73 and 74. At or near the junction of these sections the tangs 70*a*, 70*b* have therein respective bulges 75*a*, 75*b* which are formed by coining, and which press against each other to force the tangs 70*a*, 70*b* apart. Thus, considering these tangs as cantilever beams the effect of the pressing together of bulges 75 is to preload the tangs by resilient stress.

As shown in FIG. 5, the tangs 70*a*, 70*b* at their upper ends 76*a*, 76*b* have rounded outer corners 77*a*, 77*b* and, below these corners, the outer sides of the tangs have formed therein respective nicks 78*a*, 78*b* for attachment to the tangs of a test probe. When received in the passage 45 in post 25, portions of the tangs 70*a*, 70*b* project upwards of the opening 47 at the bottom of the cleft 33 in the post to thereby be exposed above such opening.

Such exposed tang portions are adapted to be enclosed by the hollow cap 80 shown in FIGS. 6–11. Cap 80 is a molded synthetic resinous integral part. The exterior 81 of cap 80 has a gentle convergent taper (FIG. 10) from the caps bottom 82 to a level 83 about two-thirds of the way up to the top of the cap. The cap's exterior 81 has an outline in horizontal cross-section generally conforming (FIG. 9) to a square with rounded corners. Above level 83, the exterior 81 is shaped to provide a handle 84 upstanding from level 83 and being at its top 79 of generally rectangular form in horizontal cross-section. The handle is coupled at its front and back sides by shoulders 85, 86 to the front and back top margins of the square cap section 87 below the handle. The handle 84 has formed therein crescent shaped indentations 88 facilitating firm gripping of element 84 by the hand. As another feature of the handle 84, its side walls 85, 86 are perforated by apertures 89*a*, 89*b* providing upward passage through the body of the handle and appearing as triangular shaped elements in FIG. 9.

At the bottom of cap 80, a pair of claws 95*a*, 95*b* are formed on opposite sides of the cap axis 96 and point inwards towards that axis. The claws 95 are adapted to cooperate at separate times with respectively, the grooves 55 and 57 on post 25 to provide therewith first and second detent means, respectively, which will be later described in more detail.

Considering now the interior of cap 80, such interior progresses upward from a shallow recess 99 of square rounded-corner horizontal cross-section (FIGS. 8 and 11) to a large post-holding cavity 100 extending up into the cap and of smaller horizontal cross-section than such recess. Cavity 100 is bounded around cap axis 96 by a circumferential interior wall 101 having a gentle upwardly convergent taper and having in horizontal cross-section a configuration (FIG. 11) which is similar in shape to the exterior surface 40 of post 25 and which, like it, is radially symmetrical but is not axially symmetrical. Above cavity 100 there extends into the handle 84 an upwardly convergently tapered vertical channel 102 having in horizontal cross-section a configuration (FIG. 11) in the form of a rectangle of which the center plane 102 is (when cap 80 is seated on post 25) at 45° to the centerlines of the rows and columns of posts on base 22 (FIG. 1). The cross-section of channel 101 is substantially greater in size in its width dimension (parallel to centerplane 103) than in its thickness dimension (normal to centerplane 102). At its top and on opposite sides of cap axis 96, the channel 101 is rendered open to the exterior of cap 80 by the apertures 89 already described.

Figure 8:
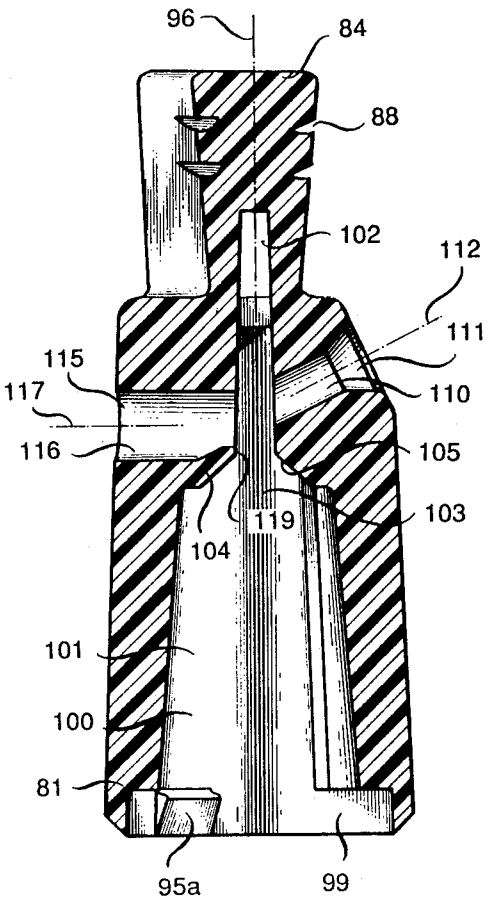
FIG. 8 is another diagonal cross-section, taken as indicated by the arrows 8—8 in FIG. 6 of the FIG. 6 cap, the FIG. 8 cross-section being diagonal to the FIG. 7 cross-section.
Figure 7:
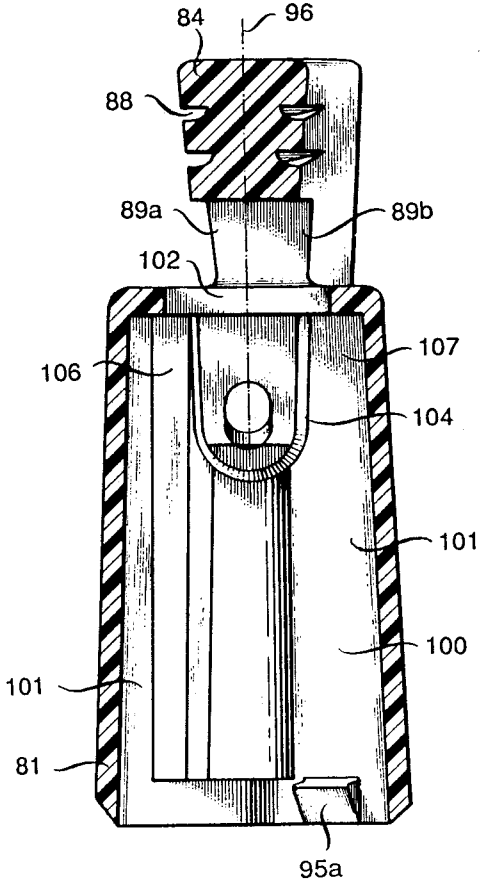
FIG. 7 is a diagonal cross-section, taken as indicated by the arrows 7—7 in FIG. 6 of the FIG. 6 cap.
Figure 15:
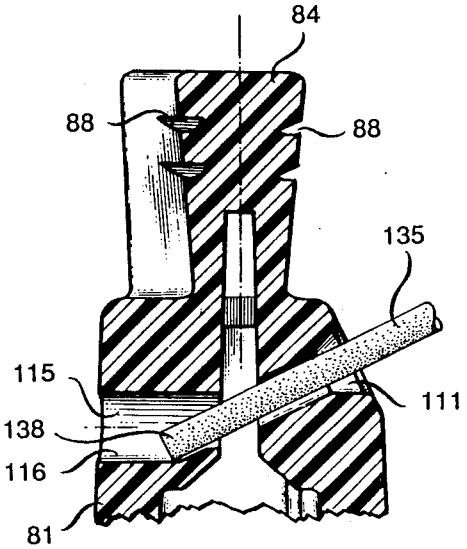
FIG. 15, a fragmentary cross-sectional view of the cap showing insertion thereinto of the lead.
Figure 11:
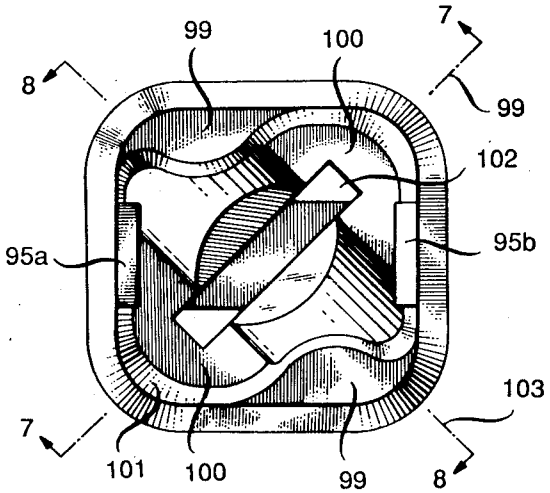
FIG. 11 is a bottom view of the FIG. 9 cap.
Figure 10:
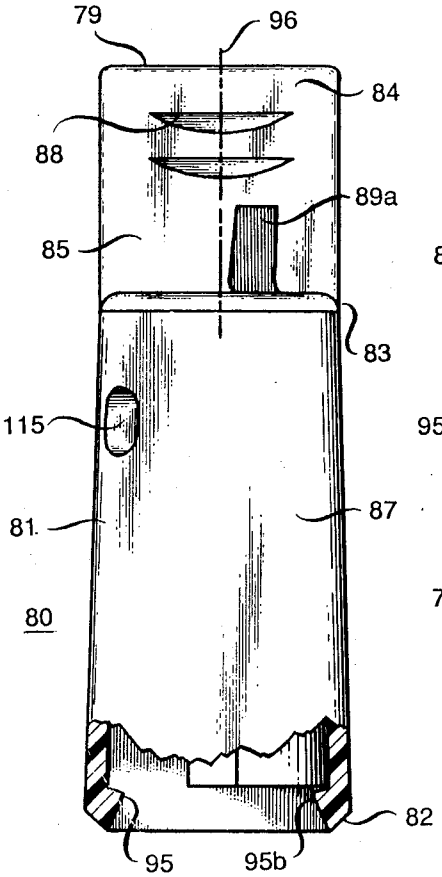
FIG. 10 is a front elevation of said cap as shown in FIG. 9.

A faired entrance is provided from the top of cavity 100 into the channel or slot 102 by an upwardly convergently tapered hollow 103 of elliptical form in horizontal cross-section (FIGS. 8 and 11). Hollow 103 is bounded on opposite sides of axis 96 (FIG. 8) by the lower parts of a pair of solid bosses 104, 105 extending downward from the top of cavity 100 and generally of upside-down "U" shape (see 104 in FIG. 7), the two bosses being generally axially symmetrical about the cross-sectioning plane for FIG. 8. The bosses 104, 105 divide the upper part of cavity 100 into two chambers 106*a*, 106b formed between the sides of those bosses and the cavity wall 101. The chambers 106, 107 are adapted in the use of cap 80 for receiving therein the ams 31, 32 of the post 25.

The cap 80 has formed therein an entrance hole 110 extending from the outside of the cap centrally through boss 105 to the channel 102 so as to open onto the lower part of such channel. Hole 110 is for the most part cylindrical but has a frustro-conical outer part 111 providing a faired opening into the hole. The centerline 112 of hole 110 has in the inward direction (i.e., from the cap's outside towards its axis 96) a downward slant (FIG. 8). Moreover, centerline 112 is oriented in the horizontal plane to be adapted to be at 45° (FIG. 6) to the centerlines of the post rows and post columns on base 22 (FIG. 1) and thus to be in diagonal relation to such row and column centerlines.

The cap 80 has also formed therein on the opposite side of axis 96 from entrance 110 an exit hole 115 extending from the lower part of channel 102 through boss 104 to the outside of the cap. Hole 115 is somewhat larger in crosssection than entrance hole 110, and the interior wall 116 of the exit hole is cylindrical. Exit hole 115 has a horizontal centerline 117 which is in the same vertical plane as centerline 112 of entrance hole 110 so that centerline 117 is adapted in the use of cap 80 to be at an angle of 45° to (and, thus, in diagonal relation with) the centerlines of the rows and columns of posts 25 on terminal board 20. Inasmuch, however, as centerline 117 is horizontal while centerline 112 has a downward slant in the inward direction, the centerline of the exit hole diverges at an angle away from the centerline of the entrance hole, and the interior wall 116 of the exit is accordingly cocked in relation to the entrance hole centerline 112. While (FIG. 8) the opening into the channel 102 of the exit hole is slightly below the opening into such channel of the entrance hole, the entrance hole centerline 112 because of its downward slant is, after it crosses such channel, well within such exit hole opening and, as shown, centerline 112 continues beyond such opening into the exit hole 115 until the line 112 intersects with such holes interior wall 116. The opening of the exit hole into channel 102 has a bottom lip 118 of which the front portion 119 is faired to promote guidance of a lead into the exit hole.

USE AND FEATURES OF EMBODIMENT

Figure 12:
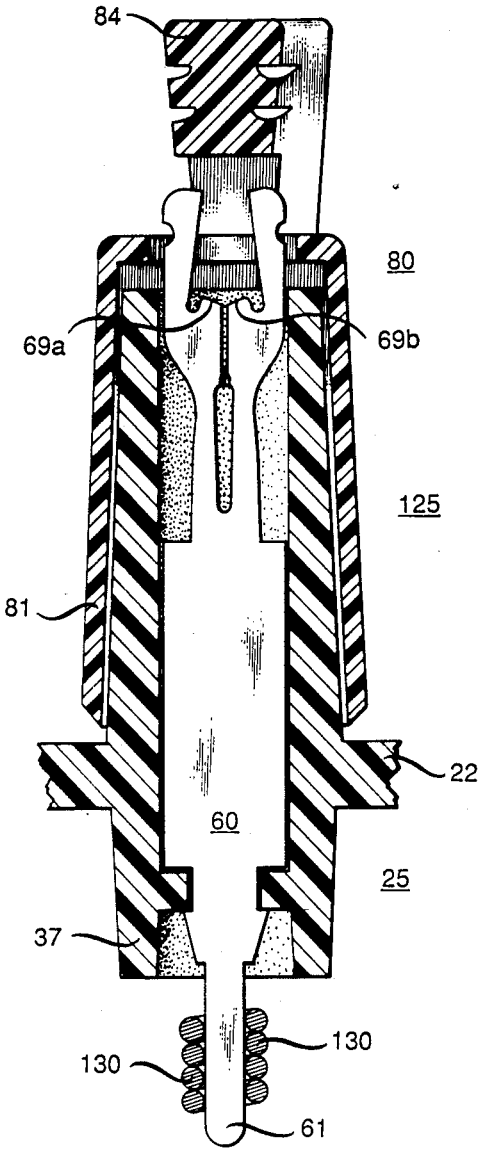
FIG. 12 is a schematic view in cross-section taken in the direction of the arrows 7—7 in FIG. 6 of a terminal comprising an assembly of the post, terminal strip and cap when the cap is in its down position on the post.

Post 25, terminal strip 60 and cap 80 are assembled together in a manner as follows. Referring to FIG. 12, the strip 60 is driven down into the interior of the post to force the barbs 66 on tapered section 63 of the strip through the constricted width section 54 of the vertical channel 50 in the post. Once the barbs have passed through that section; the rearward facing shoulders 67 on the barbs inhibit withdrawal of the strip from the post while the greater width of strip section 64 than strip section 63 prevents further forward movement of the strip into the post. Thus strip 60 becomes locked into the post so as to be separable therefrom only by the exercise of sizable pulling force on the strip.

When the strip becomes so held the tangs 70 on the strip project sufficiently above the bottom of "U" cleft 33 in the post that the cutting edges 69 on such tangs and at least part of the contact gap 72 between them are above such bottom to be exposed. Moreover, the outer margins of the lower parts of the tangs 70 are received in the guideways 51, 52 formed in post arms 31, 32 to receive support from the walls of such guideways against undesired deflection of the upper section 65 of the strip in the direction normal to its width dimension. The wide side walls of the upper part of slot 102 in cap 80 provides further support means for that purpose.

After insertion of the strip 60 into the post, the cap 80 is positioned over and in coaxial relation with the post such that the configuration in horizontal cross-section of the interior wall 101 (FIG. 11) of the cavity 100 in the cap matches in angular orientation to the configuration is horizontal cross-section of the exterior surface 40 of the post. The cap is then pushed down on the post until the claws 95 on the cap snap fit into the upper grooves 55 on the outside of the post to form with such grooves a first detent means maintaining the cap at an "up" position therefor on the post. While the cap can be pulled upwardly from such detained position to do is difficult because of the relatively small downward slant in the inward direction of the downwardly directed faces 56 bounding the upper sides of the grooves 55. On the other hand the cap can be relatively easily forced further downward on the post from its up position at which it is initially detained.

The described up position of cap 80 is the one in which it is placed when the terminal 125 consisting of elements 25, 60 and 80 is to have a lead connected thereto. Prior to the time of making such connection, however, the cap is ordinarily pushed down on the post beyond its up position until the cap's claws 95 snap fit into the lower grooves 57 on the outside of the post to form with such lower grooves a second detent means maintaining the cap in a "down" position therefor on the post. Because of the relatively great inwardly downward slant of the upper faces 58 of grooves 57, the cap may be relatively easily be released from its detained down position to be moved upward on the post to, say, its up position thereon. In the course of moving the cap to its up position the upper ends of the tangs 70 in strip 60 will pass through the apertures 89 in the cap to become exposed on the outside of the cap. FIG. 12 shows cap 80 in its down position on post 25 to be retained thereon until the time comes to ready terminal 125 for connection of a lead thereto.

Figure 9:
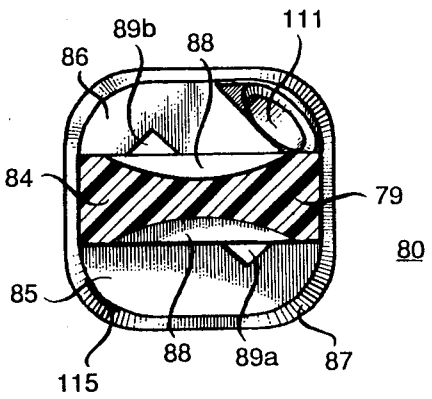
FIG. 9 is a plan view of the FIG. 6 cap when rotated 180° from its position shown in FIG. 6.

When the cap 80 is fitted over post 25 as described, the exterior surface 40 of the post and the interior surface 101 of the cap overlap and engage in a common vertical region. Because of the horizontal cross-sectional configurations of these two surfaces, the cap may be fitted on the post so that entrance hole 110 faces downward and leftward (FIG. 6) or so that such entrance hole 110 faces upward and rightward (FIG. 9). Those two positions of the cap on the post are 180° apart around the axis 29 of the post. The described configurations of the overlapping engaging surfaces of, respectively, the cap and post permit the cap to assume such two angular positions relative to the post while being fitted thereon and, at the same time, prevent the cap from fitting over the post in any other angular positions and restrict the fitted cap from angularly moving on the post from such positions. Because the cap can have such two positions, a lead can be connected to strip 60 either frontwardly or backwardly. An advantage of having the cap fittable on the post in either of such two positions is that, when the terminal board 20 (FIG. 1) is vertical and leads are being connected thereto, the entrance holes in the caps can be made to face towards the eyes of the workman doing the connecting whether the board is mounted above or below the head of such workman.

The terminal board 20 (FIG. 1) includes terminals respectively comprising the posts upstanding in the shown rows and columns from base 22, each of such terminals being the same in constituents and structure as that described and shown (FIG. 12) for terminal 125.

As a preliminary to connecting-up the last-named terminal, the stem portion 61 of its terminal strip 60 is electromechanically connected to a wire 130 by wrapping the free end of such wire around the stem by a wire wrapping tool (not shown). Such wire may be spliced to one of the wires included in a feeder cable from a central office of the telephone network, others of such wires in the cable being similarly connected to the others of the terminals on terminal board 20. After all desired connections of such wires to such board have been made, the region on the widerside of base plate 22 within its circumferential downstanding flange 26 (FIG. 4) is filled with potting compound to protect and maintain the wire wrap connections between such wires and the terminals to which they are respectively connected.

Figure 13:
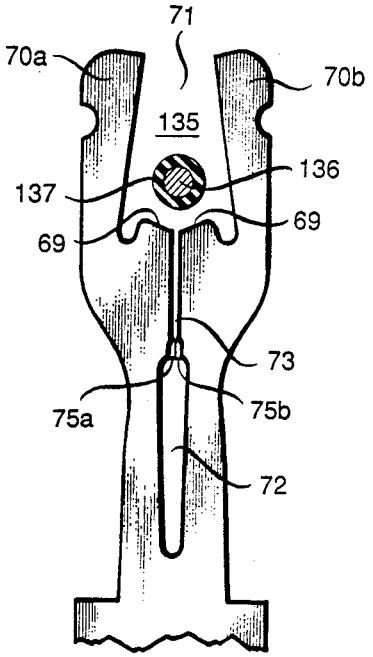
FIG. 13 is a fragmentary view of the top of the FIG. 5 terminal strip and (in cross-section) of an insulated wire lead as positioned prior to making contact with the strip.

As another preliminary to connecting up terminal 125, the cap 80 thereon is shifted from its down position thereon (FIG. 12) to its up position which the bottoms of the entrance and exit holes in the cap are positioned above the tops of the cutting edges 69 on the tangs. Further, the centerline 112 of the entrance hole 110 passes between the tangs 70 to enter into the exit hole 115. Once cap 80 has been so moved up, the terminal 125 is ready for connection of it's upper part to an insulated wire lead 135 comprising (FIG. 13) a metallic core 136 (constructed of, say, copper filaments) and insulation 137 around such core.

The lead 135 is inserted into cap 80 by grasping between the fingers of one hand an end section of the lead, guiding the free end 138 of the lead into the entrance hole 110 in cap 80, aligning the centerline of such end section to approximately coincide with the centerline 112 of hole 110 and then, keeping such alignment, feeding the lead forward into the hole until its end 138 enters and extends into exit hole 115 and finally makes contact at its bottom with its interior wall 116. Such contact almost never fails to occur upon feeding lead 135 into the cap as described because wall 116 of the exit hole is cocked in relation to entrance hole centerline 112. The making of such contact produces on the lead a stopping force which is fed back to and tactilely detectable by the person manipulating the lead so, as in the ordinary case, to signal that person to cease feeding the lead into the cap. The cocked hole wall 116 acts, however, as a stop means for lead 135 which is provisional in the sense that such person can override the impeding effect of the wall on the lead monitor by increasing a forward force exerted on the lead and manipulating it to resume forward movement. When this is done, the lead can be threaded all the way through the exit hole to emerge therefrom so as to permit any desired length of the lead to be fed all the way through and then out of cap 80. It follows that a portion of lead 135 emergent from terminal 125 can be led to and possibly all the way through one or more other terminals on board 20. Thus, that lead portion may be used to provide an electrical bridging connection between terminal 125 and such other terminal or terminals.

Figure 14:
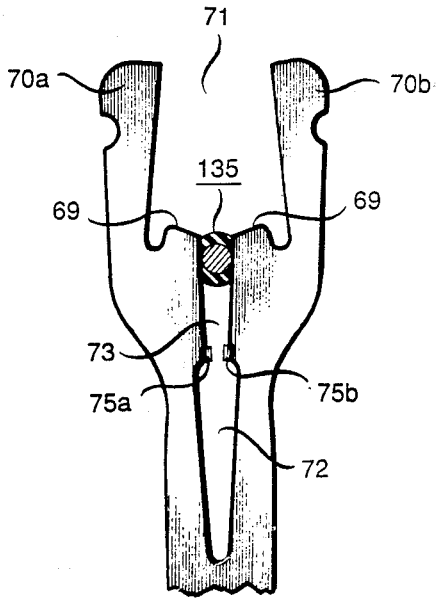
FIG. 14 is another view of said terminal as shown in FIG. 13 except that the lead is shown as positioned after it has made contact with the strip.

In the course of feeding lead 135 as described, first through entrance hole 110 and then at least partly through exit hole 115, while cap 80 is in up position, the lead 135 passes (FIG. 13) through the notch 71 between the tangs 70 above the top of the contact gap 72 between such tangs. Once such feeding of the lead has been completed, the cap 80 is pushed on post 25 from the cap's up position to its down position. Because the lead is received on opposite sides of terminal strip 60 in holes in the cap, the downward movement on the post of the cap will carry with it the lead and force the portion thereof between tangs 70 to be driven downward such that, first, the insulation 137 of that lead portion is cut by the cutting edges 69 on the tangs and, second, that lead portion is forced down (FIG. 14) into contact gap 72 to result in direct electromechanical contact between the core 136 of the lead and the sides bordering gap 72 of the tangs 70. The driving of the lead into gap 72 produces outward forces on the two cantilever beams constituted of tangs **70*a*, 70*b*** such that both beams are resiliently deflected away from the center of the gap to be spread apart.

Thus, by the mere feeding of the lead 135 (as described) into the cap of terminal 125 and subsequent pushing down of such cap on the post of such terminal, the upper part of such terminal becomes electrically connected to the lead to in turn produce an electrical connection of such lead through the terminal strip of such terminal to wire 130 already connected thereto. The threading of the lead into cap 80 of the terminal is facilitated by the consideration that, because of the inwardly downward slant of entrance hole 110, the hand which guides and feeds the lead into the hole can be disposed well away from the other terminals on board 20 to avoid contact with those other terminals on board and thus not be interfered with in the process of effecting such threading. Avoidance of such interference is also furthered by the fact that, for either of the two described positions on which the cap is fittable on the post of the terminal, the entrance hole centerline will be at 45° to the lines of the rows and columns of the terminals on the board. As another advantage, once the terminals of the board have been connected up as described, the electrical parts within each terminal are accessible to testing without removable of cap 80 by connecting a test probe to one of the nicks 78 in the portions of tangs 70 which project through and upward of the apertures 89 in the cap.

The above described embodiment being exemplary only, it is to be understood that additions thereto, omissions therefrom and modifications thereof can be made without departing from the spirit of the invention. Accordingly, the invention is not to be considered as limited save as is consonant with the recitals of the following claims.

What is claimed:

1. A push cap terminal for a lead with a metallic core and insulation comprising: a post having a vertical axis, a base region and a channel therein extending in said post from said base region to a forward opening in said post; a metallic terminal strip received in said channel and having a lower portion connectable to a wire and an upper portion exposed above said opening and comprising a pair of tangs with cutting edges thereon and a vertical contact gap between such tangs; and a cap with a hollow therein and fittable in an up position on said post to cover said tangs and gap, said cap being perforated by an entrance hole having a centerline extending diagonally downward into said hollow to pass between said tangs above said gap when said cap is up, said hole being adapted to have said lead inserted therein to also pass between said tangs above said gap when said cap is up, and said cap being adapted to be then pushed down on said post to drive said lead downward between said tangs so as to produce a cutting of its insulation by said edges and a subsequent positioning of its core in said gap to thereby make electromechanical contact between said core and tangs.

2. A push cap terminal according to claim 1 in which said cap is fittable on said post in either one of two predetermined angular positions relative thereto which are on opposite sides of said axis, and at either of which said cap is restricted in angular movement relative to said post.

3. A push cap terminal according to claim 2 in which said cap and post have, respectively, inner and outer peripheral surfaces adapted when said cap is fitted in said post to overlap and engage in a vertical region common to said cap and post, and in which such surfaces have respective shapes in horizontal cross-section in such region which preclude fitting of said cap on said post except in either one of said two angular positions.

4. A push cap terminal according to claim 1 in which said cap is perforated by an exit hole for said lead disposed on the opposite side of said axis from said entrance hole and extending outwardly through the body of said cap from the hollow therein to the outside thereof, said exit hole having at its junction with said hollow an inner opening towards which said entrance hole's centerline extends.

5. A push cap terminal according to claim 4 in which said exit hole has a centerline diverging at an angle in the outward direction away from said centerline of said entrance hole.

6. A push cap terminal according to claim 4 in which said inner opening of said exit hole has fairing furthering threading into such exit hole of said lead when inserted into said entrance hole.

7. A push cap terminal according to claim 1 further comprising detent means provided by said post and cap and adapted by snap-fitting of respective parts thereof to releasably hold said cap in said up position on said post.

8. A push cap terminal according to claim 1 further comprising detent means provided by said post and cap and adapted by snap-fitting of respective parts thereof to releasably hold said cap in a down position on said post after said cap has been pushed from said up position thereof to said down position.

9. A push cap terminal according to claim 1 in which said cap has formed therein at least one upper aperture adapted upon said pushing down of said cap to have the upper part of a corresponding one of said tangs pass through such aperture and become exposed above it to permit the making outside of said cap of a test connection to such upper part.

10. A push cap terminal according to claim 1 in which said terminal strip is of greater width than thickness, said tangs are spread apart in the width dimension of said strip, and said tangs are received in at least one of said post and cap in guideways supportive of said tangs against undue bending thereof in the thickness dimension of said strip while permitting said tangs to constitute respective cantilever beams each resiliently deflectable in said width dimension away from the center of said gap in response to such driving down of said lead between said tangs.

11. A terminal board for connection thereto of insulated wire leads comprising, a base in the form of a horizontal plate, and a plurality of terminals upstanding from the top side of said base and arranged in lines of rows and columns, each of said terminals comprising housing means and electroconductive means at least partly in said housing means and having a portion connectable to a wire, said housing means of each of said terminals being perforated by an entrance hole passing through said housing means and having a centerline with a predetermined maintained diagonal orientation relative to such row lines and column lines, such entrance hole of each such terminal being adapted to have one of such leads inserted therein for electromechanical connection in said terminal's housing means of such lead to such terminal's electroconductive means.

12. A terminal board according to claim 11 in which said housing means of each such terminal comprises a hollow post and a hollow cap fitted on such post and having said entrance hole formed therein, and in which such cap is fittable on said post in either one of two positions for which said hole faces in opposite directions relative to said board and has a predetermined maintained diagonal orientation at each such position in relation to such row lines and said column lines, said cap at each of such positions being restricted in angular movement relative to said cap.

13. A terminal board for connection thereto of insulated wire leads comprising a base in the form of a horizontal plate, and a plurality of terminals upstanding from the top side of said base and each comprising housing means and electroconductive means at least partly disposed in said housing means and having a portion connectable to a wire, said housing means of each of said terminals being perforated by an entrance hole passing through such housing means in the inward direction from the outside to the inside of such housing means and having a centerline slanting downwards in such direction towards said base, and such entrance hole of each such terminal being adapted to have one of such leads inserted therein for electromechanical connection in such terminal's housing means of such lead to such terminal's electroconductive means.

14. A terminal for an insulated wire lead comprising, housing means upstanding from a base region therefor electroconductive means disposed at least partly in said housing means and having a portion connectable to a wire, said housing means being perforated by an entrance hole which passes through such housing means in the inward direction from the outside to inside thereof, and which slants downward in such direction towards said base region, said hole being adapted for insertion therein of said lead for electromechanical connection in said housing means of said lead to said electroconductive means.

15. A terminal for an insulated wire lead comprising: a housing upstanding from a base region therefor and having a vertical axis, electroconductive means disposed at least partly in said housing and having a portion connectable to a wire, and a cap disposed on said housing and perforated by a hole adapted when said cap is so disposed to have said lead inserted therein for electromechanical connection in said housing of said lead with said electroconductive means, said cap being fittable on said housing in either of two angular positions relative thereto at each of which said cap is restricted in angular movement thereof relative to said housing, and at one and the other of which positions said inserted lead is connectable in said housing frontwardly and backwardly, respectively, with said electroconductive means.

16. A terminal according to claim 15 in which such housing, and cap have, respectively, inner and outer non-circular peripheral surfaces adapted when said cap is fitted on said housing to overlap and engage in a vertical region common to such housing and cap, and in which such surfaces have respective shapes in horizontal cross-section in such region which preclude fitting of said cap on said housing except in either one of said two angular positions.

17. A terminal for an insulated wire lead comprising, a housing upstanding from a base region therefore and having a vertical axis, electroconductive means disposed at least partly in said housing and having a portion connectable to a wire, said housing being perforated on opposite sides of said axis by entrance and exit holes of which said entrance hole is adapted to have said lead inserted therein for electromechanical connection in said housing of said lead to said electroconductive means, and of which said exit hole is adapted to permit passage therethrough and then outward from said housing a length of said lead forward of such connection, and provisional stop means present in said housing and adapted to be engaged by said lead inserted into said entrance hole to impede passage of said lead through said exit hole and to provide a tactilely detectable feeling of stoppage of such lead, such stop means being further adapted upon subsequent manipulation and forcing of said lead to cease its impeding action and permit passage of such lead through said exit hole.

18. A terminal for an insulated wire lead comprising, an upstanding insulative housing, electroconductive means disposed at least partly in such housing and having a portion connectable to a wire, a cap initially seatable in an up position on said housing, and adapted to be forcibly pushed down from said up position to a down position on said housing, means permitting insertion of said lead into the space enclosed by such housing and cap and for effecting connection in said space of said inserted lead with said electroconductive means, and first and second detent means provided by said housing and cap and each adapted by snapfitting action of respective parts thereof on, respectively, said housing and cap to releasably hold said cap in said housing in, respectively, said up position and said down position for said cap.

19. A terminal for a lead with a metallic core and insulation thereon comprising: housing means, electroconductive means disposed at least partly in said housing means and having a first portion connectable to a wire and a second portion of greater width dimension then thickness dimension, said second portion comprising a pair of tangs spaced apart in such width dimension and provided with respective cutting edges and having between them a contact gap, means permitting insertion of said lead into said housing means to pass between said tangs outward of said gap, and to subsequently effect forcing of such inserted lead into contact with said edges and then into said gap to thereby cut such lead's insulation and produce electromechanical contact between the core of such lead and said tangs, and support means in said housing means backing said tangs against undue bending thereof in said thickness dimension while permitting said tangs to constitute respective cantilever beams each resiliently deflectable in said width dimension away from the center of said gap.

20. The method of manufacturing a terminal board comprising, molding a piece comprising a synthetic resinous base in the form of a horizontal plate, and a plurality of hollow synthetic resinous posts integral with said base and upstanding therefrom and having therein respective vertical channels having lower openings on the bottom side of said base and upper openings above the top side thereof, inserting into the channel of each such post a metallic terminal strip having a lower portion projecting below the bottom of said base and an upper portion exposed above such upper opening of that post, molding a plurality of synthetic resinous caps for said posts, and seating one of said caps on each of said posts to enclose such upper portion of the terminal strip inserted in such post's channel.

* * * * *